US008010004B2

(12) United States Patent
Tachiki et al.

(10) Patent No.: US 8,010,004 B2
(45) Date of Patent: Aug. 30, 2011

(54) BELT TRANSFER DEVICE

(75) Inventors: Hiroshi Tachiki, Nara (JP); Takashi Makiura, Nara (JP); Kohichi Yamauchi, Yamato-Koriyama (JP); Takahiko Yoshida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 890 days.

(21) Appl. No.: 11/955,447

(22) Filed: Dec. 13, 2007

(65) Prior Publication Data

US 2008/0145083 A1 Jun. 19, 2008

(30) Foreign Application Priority Data

Dec. 15, 2006 (JP) ..... 2006-338967

(51) Int. Cl.
*G03G 15/16* (2006.01)

(52) U.S. Cl. ..... 399/66; 399/121; 399/154; 399/297; 399/298; 399/299; 399/300; 399/301; 399/302; 399/308

(58) Field of Classification Search ..... 399/66, 399/121, 154, 165, 297–302, 308
See application file for complete search history.

(56) References Cited

U.S. PATENT DOCUMENTS 5,376,999 A * 12/1994 Hwang ..... 399/299
5,893,017 A * 4/1999 Yamamoto ..... 399/299
5,991,561 A * 11/1999 Okamoto et al. ..... 399/66
6,029,023 A * 2/2000 Munemori et al. ..... 399/66
6,061,542 A * 5/2000 Minami et al. ..... 399/299
6,134,402 A * 10/2000 Nakayama et al. ..... 399/101
6,173,141 B1 * 1/2001 Sakagami et al. ..... 399/167
6,201,944 B1 * 3/2001 Onuki et al. ..... 399/299
6,301,451 B1 * 10/2001 Ando et al. ..... 399/38
6,334,039 B1 * 12/2001 Yoshinaga et al. ..... 399/298
6,356,732 B1 * 3/2002 Watanabe et al. ..... 399/299
6,385,427 B1 * 5/2002 Nakane ..... 399/303
6,766,137 B2 * 7/2004 Yasui et al. ..... 399/299
6,941,102 B2 * 9/2005 Sasamoto et al. ..... 399/299

(Continued)

FOREIGN PATENT DOCUMENTS

JP 11-015290 1/1999

(Continued)

OTHER PUBLICATIONS

English machine translation of Japanese patent publication Kanekura et al. (JP pub 2001-296718).*

*Primary Examiner* — David Gray
*Assistant Examiner* — Geoffrey Evans
(74) *Attorney, Agent, or Firm* — Renner, Otto, Boisselle & Sklar, LLP

(57) ABSTRACT

A belt transfer device according to the present invention includes an intermediate transfer belt, a transfer member, a shifter, a detector, and a controller. The transfer member primarily transfers a toner image from an image carrier to the intermediate transfer belt. The shifter reciprocates in specified opposite directions so as to shift the transfer member between a transfer position where the transfer member is in compressive contact with the inner surface of the intermediate transfer belt and a home position where the transfer member is away from the belt surface. The detector outputs a signal representing the position of the shifter. Based on the state of the signal output from the detector while the shifter is reciprocating each time in the opposite directions, the controller determines whether the tensile force of the intermediate transfer belt is proper.

7 Claims, 6 Drawing Sheets

U.S. PATENT DOCUMENTS

| | | | | |
|---|---|---|---|---|
| 7,333,758 | B2 * | 2/2008 | Munakata et al. | 399/299 |
| 7,392,001 | B2 * | 6/2008 | Okazaki | 399/299 |
| 7,620,353 | B2 * | 11/2009 | Kwak | 399/302 |
| 7,664,444 | B2 * | 2/2010 | Mochizuki | 399/302 |
| 7,751,762 | B2 * | 7/2010 | Hatayama et al. | 399/299 |
| 7,756,453 | B2 * | 7/2010 | Yamazaki | 399/299 |
| 2002/0018673 | A1 * | 2/2002 | Mizoguchi et al. | 399/298 |
| 2004/0184827 | A1 * | 9/2004 | Yamada | 399/44 |
| 2006/0177246 | A1 * | 8/2006 | Kawada et al. | 399/301 |
| 2007/0059051 | A1 * | 3/2007 | Kaiho | 399/299 |
| 2007/0071486 | A1 * | 3/2007 | Chiba et al. | 399/101 |
| 2007/0116496 | A1 * | 5/2007 | Morimoto et al. | 399/299 |
| 2007/0134028 | A1 * | 6/2007 | Funabashi | 399/299 |
| 2007/0140733 | A1 * | 6/2007 | Hirayama | 399/110 |
| 2009/0060599 | A1 * | 3/2009 | Sano et al. | 399/301 |
| 2009/0252517 | A1 * | 10/2009 | Tachiki et al. | 399/66 |
| 2009/0317150 | A1 * | 12/2009 | Lee et al. | 399/308 |

FOREIGN PATENT DOCUMENTS

| | | | |
|---|---|---|---|
| JP | 2001296718 | A * | 10/2001 |
| JP | 2003-186313 | | 7/2003 |
| JP | 2004-109267 | | 4/2004 |

* cited by examiner

BELT TRANSFER DEVICE

CROSS REFERENCE

This Nonprovisional application claims priority under 35 U.S.C. §119(a) on Patent Application No. 2006-338967 filed in Japan on Dec. 15, 2006, the entire contents of which are hereby incorporated by reference.

BACKGROUND OF THE INVENTION

The present invention relates to a belt transfer device applied to an apparatus for electrophotographic image formation, which includes an image carrier. The belt transfer device includes an intermediate transfer belt made of elastic material. The belt transfer device primarily transfers a toner image on the image carrier to the intermediate transfer belt and secondarily transfers the image on the belt to a sheet of paper or another record medium such as an OHP sheet.

Some apparatuses for electrophotographic image formation such as printers and copiers include an image carrier and a belt transfer device, which includes an intermediate transfer belt made of elastic material and a transfer member. The intermediate transfer belt runs in a loop. The transfer member can shift toward the image carrier so as to bring the intermediate transfer belt into compressive contact with the carrier. The belt transfer device primarily transfers a toner image on the image carrier to the intermediate transfer belt and secondarily transfers the image on the belt to a sheet of paper. The length of the intermediate transfer belt depends on the size of the largest sheets on which the associated apparatus can form images.

Because the sheet size series for frequent use with apparatuses for image formation vary with their various destinations, intermediate transfer belts of different lengths are provided for the destinations. Because the intermediate transfer belt of an apparatus for image formation deteriorates with time as the apparatus repeats image formation, the belt needs to be replaced when the apparatus has repeated image formation a specified number of times.

The tensile force of the intermediate transfer belt fitted to the belt transfer device of an apparatus for image formation varies with the length of the belt. The tensile force variation varies the width of the nip formed between the intermediate transfer belt and the image carrier of the apparatus when the transfer member of the belt transfer device brings the belt into compressive contact with the carrier. The nip width variation varies the toner image transfer performance of the apparatus. Therefore, the monochromatic unit of the belt transfer device includes a tension member for applying, to the intermediate transfer belt, tensile force according to the length of the belt.

A belt transfer device is also used in a tandem apparatus for color image formation, which includes image carriers arrayed in a line. The image carriers are a monochromatic image carrier for carrying a monochromatic toner image and three color image carriers for carrying toner images of the three primary colors. The tandem apparatus forms monochromatic images more frequently than color images. The monochromatic image carrier is larger in diameter than the color image carriers so that the lives of all the carriers can be equal, and so that the tandem apparatus can form monochromatic images at a higher speed than color images. Each type of tandem apparatus for color image formation is fitted with a monochromatic image carrier of a diameter according to the speed at which the apparatus is required to form monochromatic images. By contrast, because it is strongly demanded that tandem apparatuses for color image formation form color images of high quality, the color image carriers of the apparatuses have a diameter common to the apparatuses.

In a tandem apparatus for color image formation, the distance between the monochromatic image carrier and each of the color image carriers depends on the diameter of the monochromatic image carrier. JP-A-2004-109267 discloses a conventional belt transfer device including a color unit and a monochromatic unit. The color unit supports color transfer members. The monochromatic unit supports a monochromatic transfer member, which primarily transfers a monochromatic toner image. Monochromatic units of some types are provided for different diameters of monochromatic image carriers. The belt transfer device of a tandem apparatus for color image formation includes a combination of a color unit of the single type and a monochromatic unit suitable for the diameter of the monochromatic image carrier of the apparatus. The two units are fitted to the main frame of the belt transfer device.

The process for producing an intermediate transfer belt includes injection-molding an elastic material into an endless belt, extending the endless belt to a specified length in a heating mold, and cooling the extended belt. While the belt is heated and cooled during the production process, its thermal deformation is liable to produce an error in the length of the belt. If a wrong intermediate transfer belt is fitted to the belt transfer device of a tandem apparatus for color image formation during the assembly or maintenance of the apparatus, the tensile force of the belt is not proper. This lowers the toner image transfer performance of the apparatus, resulting in a deterioration in image quality.

The object of the present invention is to provide a belt transfer device for an apparatus for image formation, the transfer device making it possible to accurately determine whether the tensile force of its intermediate transfer belt is proper, keeping the belt under constant tension so as to maintain good image quality, and avoiding being fitted with an intermediate transfer belt of a length different from that suitable for the destination of the apparatus.

SUMMARY OF THE INVENTION

A belt transfer device according to the present invention includes an intermediate transfer belt, a transfer member, a shifter, a detector, and a controller. The transfer member primarily transfers a toner image from an image carrier to the intermediate transfer belt. The shifter reciprocates in specified opposite directions so as to shift the transfer member between a transfer position where the transfer member is in compressive contact with the inner surface of the intermediate transfer belt and a home position where the transfer member is away from the belt surface. The detector outputs a signal representing the position of the shifter. Based on the state of the signal output from the detector while the shifter is reciprocating each time in the opposite directions, the controller determines whether the tensile force of the intermediate transfer belt is proper.

The elastic force created by the tensile force of the intermediate transfer belt influences the transfer member when this member shifts between the transfer position, where it is in compressive contact with the inner surface of the belt, and the home position, where it is away from the belt surface. The intermediate transfer belt is made of elastic material, and its tensile force depends on its length. The belt length is also depended on by the speed at which the shifter moves to shift the transfer member. The shifter speed is depended on by the signal from the detector. Based on the state of the signal output from the detector while the shifter is reciprocating each time in the opposite directions, the controller determines whether the tensile force of the intermediate transfer belt is proper.

DETAILED DESCRIPTION OF THE INVENTION

Figure 1:
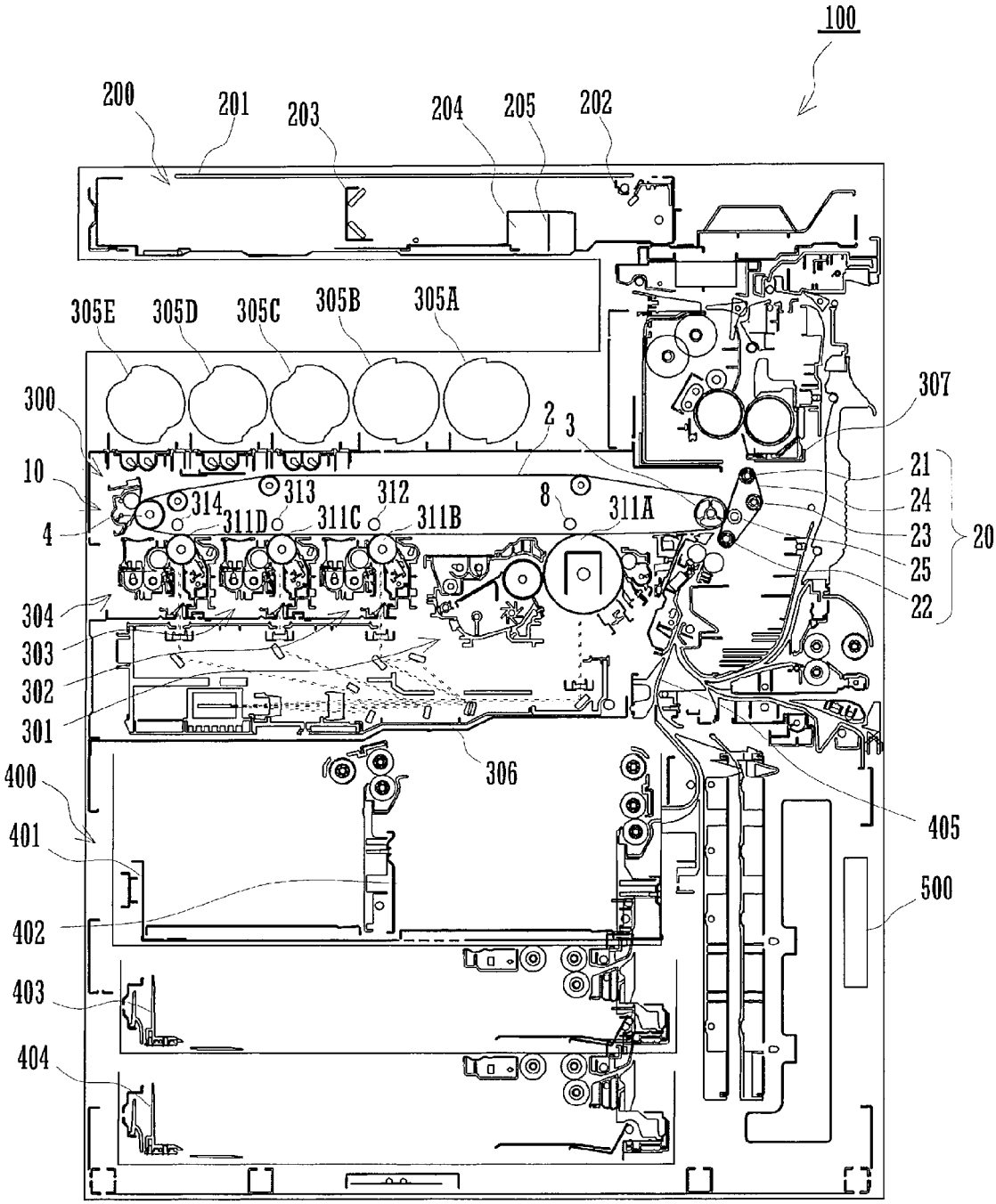
FIG. 1 is a schematic vertical section of an apparatus for color image formation, which includes a belt transfer device embodying the present invention.

The best mode of carrying out the present invention will be described below with reference to the accompanying drawings. FIG. 1 schematically shows an apparatus 100 for color image formation, which is fitted with a belt transfer device 10 embodying the invention. The apparatus 100 includes an image reader 200, an image recorder 300, a paper feeder 400, and a controller 500.

The image reader 200 includes a document platform 201, a first mirror base 202, a second mirror base 203, a lens 204, and a CCD (charge coupled device) 205.

The document platform 201 is a hard glass plate, which supports a document on its upper side. The first mirror base 202 carries a light source and a first mirror. The second mirror base 203 carries a second mirror and a third mirror.

The mirror bases 202 and 203 move horizontally under the document platform 201. The speed at which the second mirror base 203 moves is ½ of the speed at which the first mirror base 202 moves. The light source on the first mirror base 202 radiates light to the front side of the document on the platform 201. While the mirror bases 202 and 203 are moving, the light reflected by the whole of the front side of the document is incident on the CCD 205 via the three mirrors and lens 204, with the optical path length kept constant.

The CCD 205 outputs an electric signal representing the quantity of light reflected by the front side of the document. The signal is input as image data into the image recorder 300.

The paper feeder 400 includes feed cassettes 401-404, each of which holds sheets of paper of a size. The feeder 400 feeds a sheet of paper selectively from one of the cassettes 401-404 according to image size and magnification. The sheet from the feeder 400 is then fed through a feed passages 405 to the nip between an intermediate transfer belt 2 and a transfer belt 24, which run through the nip between a driving roller 3 and a secondary transfer roller 25.

The image recorder 300 includes image forming stations 301-304, toner boxes 305A-305E, an exposure unit 306, a fixing unit 307, and the belt transfer device 10.

The image forming stations 301-304 have photoconductor drums 311A-311D respectively, which correspond to the image carriers of the present invention. The station 301 forms a monochromatic toner image. The other stations 302-304 form toner images of cyan, magenta, and yellow colors respectively, which are the three primary colors for tone reduction.

The photoconductor drum 311A is used for both monochromatic image formation and color image formation. The other drums 311B-311D are used only for color image formation. The drum 311A is larger in diameter than the drums 311B-311D in order to speed up monochromatic image formation and uniformize the lives of the drums 311A-311D.

The toner boxes 305A and 305B contain a black toner, which is supplied to the image forming station 301. The other boxes 305C-305E contain cyan, magenta, and yellow toners respectively, which are supplied to the other stations 302-304 respectively.

The exposure unit 306 irradiates the cylindrical surfaces of the photoconductor drums 311A-311D with image beams modulated with monochromatic, cyan, magenta, and yellow image data respectively. The irradiation produces electrostatic latent images of the four colors on the drum surfaces. The exposure unit 306 may be a laser scanner, which includes semiconductor lasers for the four colors, a polygon mirror, and an fθ lens. The semiconductor lasers emit laser beams, which are then deflected at a constant anguler velocity by the polygon mirror and subsequently deflected at a constant velocity by the fθ lens. The laser scanner scans the cylindrical surfaces of the photoconductor drums 311A-311D with the twice deflected beams in the main scanning direction.

The fixing unit 307 includes a heating roller and a pressing roller. While a sheet of paper with toner transferred to it is passing between these rollers, the fixing unit 307 heats and presses the sheet so as to melt the toner and fix it fast on the sheet.

The belt transfer device 10 includes the intermediate transfer belt 2, the driving roller 3, a driven roller 4, and other rollers. The belt 2 runs over the rollers 3 and 4 and the other rollers, all of which are supported rotatably. The belt 2 is endless and made of rubber or other elastic material. The belt 2 runs in a loop over the photoconductor drums 311A-311D.

The belt transfer device 10 further includes transfer rollers 8 and 312-314, which are biased toward the photoconductor drums 311A-311D respectively.

The belt transfer device 10 further includes a secondary transfer unit 20. The secondary transfer unit 20 includes a driving roller 21, a driven roller 22, a tension roller 23, the transfer belt 24, and the secondary transfer roller 25. The transfer belt 24 runs over the rollers 21-23 and 25. The transfer roller 25 is biased toward the driving roller 3 so as to bring the intermediate transfer belt 2 into compressive contact with the driving roller 3, with the transfer belt 24 interposed between the transfer roller 25 and the belt 2. The belt transfer device 10 transfers the toner images on the photoconductor drums 311A-311D primarily to the outer surface of the intermediate transfer belt 2. The transfer unit 20 transfers the images on the intermediate transfer belt 2 secondarily to a sheet of paper.

Figure 2:
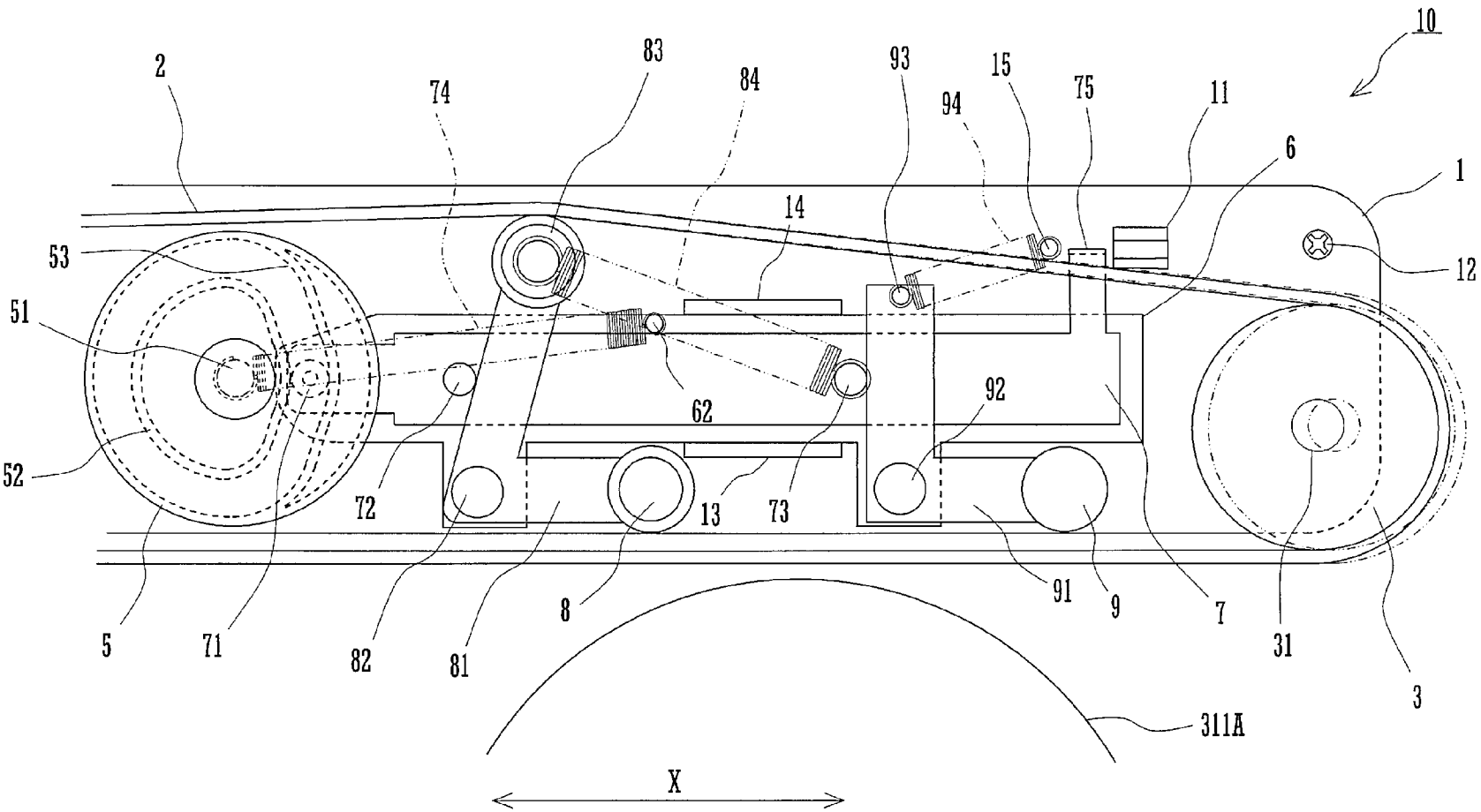
FIG. 2 is a partial side view of the belt transfer device, showing the positions of parts of it during the standby periods between processes of monochromatic image formation and color image formation.
Figure 3:
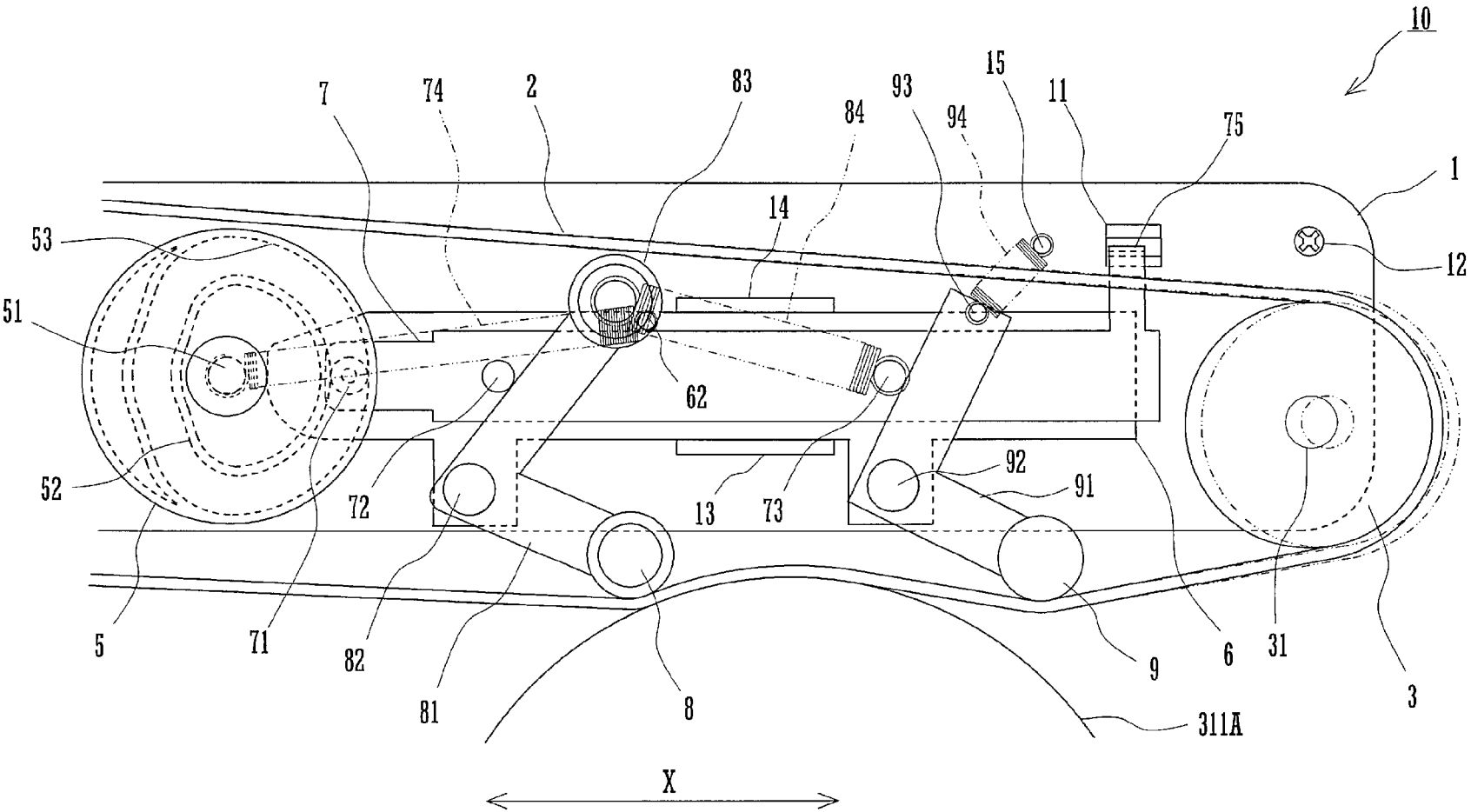
FIG. 3 is a partial side view of the belt transfer device, showing the positions of parts of it during the processes of monochromatic image formation and color image formation.

FIG. 2 shows the positions of parts of the belt transfer device 10 during the standby periods between processes of monochromatic image formation and color image formation. FIG. 3 shows the positions of these parts during the processes of monochromatic image formation and color image formation. The belt transfer device 10 further includes a main frame 1, a secondary transfer unit 20, a driving roller 3, a driven roller 4 (not-shown), a rotary cam 5, a monochromatic unit frame 6, a shifter 7, a transfer roller 8, and a nip adjusting roller 9.

The main frame 1 is fixed in position in the apparatus 100 by set screws 12 and supports the driving roller 3, driven roller 4, and rotary cam 5. The intermediate transfer belt 2 runs over these rollers 3 and 4 and other rollers. The monochromatic unit frame 6 is supported by the main frame 1 shiftably in horizontal opposite directions X, which correspond to the specified opposite directions in the present invention. The main frame 1 is fitted with guide rails 13 and 14, on which the unit frame 6 slides. The frame unit 6 is biased toward the rotary cam 5 by a tension spring 74 and positioned with its one end in contact with the shaft 51 of the cam 5.

The rotary cam 5 includes an inner cam 52 and an outer cam 53 that are formed on its back side. A grooved cam is formed between the cams 52 and 53.

The transfer roller 8, which corresponds to the transfer member of the present invention, is supported by one end of a substantially L-shaped arm 81, which is supported pivotably at its middle point 82 by the monochromatic unit frame 6. The other end of the arm 81 supports a tension roller 83. The nip adjusting roller 9 is supported by one end of a substantially L-shaped arm 91, which is supported pivotably at its middle point 92 by the unit frame 6.

The shifter 7 is supported by the monochromatic unit frame 6 reciprocatably in the directions X. The shifter 7 has a cam follower 71 and pins 72 and 73 all of which protrude on its front side. The follower 71 engages with the grooved cam, which is formed on the back side of the rotary cam 5.

One end of a compression spring 84 is connected to the shaft of the tension roller 83, which is supported by the arm 81. The other end of the spring 84 is connected to the shifter pin 73. The spring 84, which corresponds to the elastic member of the present invention, biases the arm 81 counterclockwise in FIGS. 2 and 3, so that a surface of the arm 81 is kept in compressive contact with the shifter pin 72. One end of a compression spring 94 is connected to the other end of the arm 91. The other end of the spring 94 is connected to the boss 15 of the main frame 1. The spring 94 biases the arm 91 counterclockwise in FIGS. 2 and 3, so that a surface of the arm 91 is kept in compressive contact with the shifter pin 73.

The nip adjusting roller 9 equalizes the nip between the intermediate transfer belt 2 and photoconductor drum 311A substantially in width with the nip between this belt and each of the other drums 311A-311D. The tension roller 83 keeps the belt 2 under tension during the standby periods between processes of image formation.

The monochromatic unit frame 6, shifter 7, and arm 81 correspond to the supporting mechanism of the present invention.

While the apparatus 100 is standing by between processes of image formation, as shown in FIG. 2, the transfer roller 8 and nip adjusting roller 9 are in home positions away from the inner surface of the intermediate transfer belt 2. In the meantime, the tension roller 83 presses the belt surface outward.

When the apparatus 100 forms a monochromatic or color image, the rotary cam 5 turns clockwise for 180 degrees from its position shown in FIG. 2. This shifts the shifter 7 with the cam follower 71 to the right in FIG. 2 to its position shown in FIG. 3. As a result, the shifter pins 72 and 73 turn the arms 81 and 91 respectively clockwise in FIGS. 2 and 3. This shifts the transfer roller 8 from its home position (FIG. 2) to a transfer position as shown in FIG. 3, where it keeps the intermediate transfer belt 2 in compressive contact with the cylindrical surface of the photoconductor drum 311A. This also shifts the nip adjusting roller 9 to a position where it presses the inner surface of the belt 2 downward. In the meantime, the tension roller 83 leaves the belt surface.

The shifter 7 includes a detection piece 75 extending upward from its top. The main frame 1 is fitted with a detector 11, which may be a transmission type optical detector. The detector 11 has a light emitting element and a light receiving element that face each other. While the rotary cam 5 is turning, the shifter 7 moves in the directions X, so that part of the shifter detection piece 75 moves through the space between the elements of the detector 11. This makes the detector 11 output a signal from the light receiving element.

When the apparatus 100 completes a process of image formation, the rotary cam 5 turns clockwise for another 180 degrees from its position shown in FIG. 3. This allows the elastic force of the compression springs 84 and 94 to turn the arms 81 and 91 counterclockwise, so that the transfer roller 8 and nip adjusting roller 9 shift out of contact with the inner surface of the intermediate transfer belt 2, as shown in FIG. 2.

Turning of the rotary cam 5 is converted into reciprocation of the shifter 7 in the directions X, and the reciprocation turns the arms 81 and 91. The elastic force of the compression spring 84, which biases the arm 81 counterclockwise, is sufficiently great in comparison with the tensile force acting from the intermediate transfer belt 2 to the tension roller 83 and the weights of the transfer roller 8, arm 81, and tension roller 83. The spring 84 biases the shifter 7 toward the cam 5. This keeps the cam follower 71 in compressive contact with the inner cam 52 while the cam 5 is making each turn.

The length of the intermediate transfer belt 2 depends on the size of the largest sheets on which the apparatus 100 can form images. The sheet size series for frequent use with the apparatus 100 vary with its destination. Intermediate transfer belts 2 of different lengths may be provided for various destinations of the apparatus 100.

The shaft 31 of the driving roller 3 can shift in the directions X relative to the main frame 1. If two intermediate transfer belts 2 of different lengths are provided for two or more destinations of the apparatus 100, the position of the driving roller 3 in the directions X varies with the length of the belt 2 fitted in the apparatus. This keeps the belt 2 under tension, without excessive tensile force applied to it.

Because the intermediate transfer belt 2 is made of elastic material, its thermal deformation is liable to make an error in its length while it is produced. Because the belt 2 deteriorates with time as the apparatus 100 repeats image formation, this belt may be replaced at the specified time when the apparatus has repeated image formation a specified number of times.

The monochromatic unit frame 6, shifter 7, and arms 81 and 91 form part of a monochromatic unit. Such monochromatic units are provided for different diameters of the photoconductor drum 311A. The belt transfer device 10 is fitted with the monochromatic unit for the diameter of the drum 311A fitted in the apparatus 100. The drum diameter depends mainly on the speed at which the apparatus 100 forms monochromatic images.

The transfer roller 8 and nip adjusting roller 9 are supported by the arms 81 and 91 respectively, which are supported pivotably by the monochromatic unit frame 6. By fitting the monochromatic unit for the diameter of the photoconductor drum 311A to the main frame 1, it is possible to arrange the rollers 8 and 9 according to the drum diameter. The arms 81 and 91 might be supported pivotably by the main frame 1.

Figure 4:
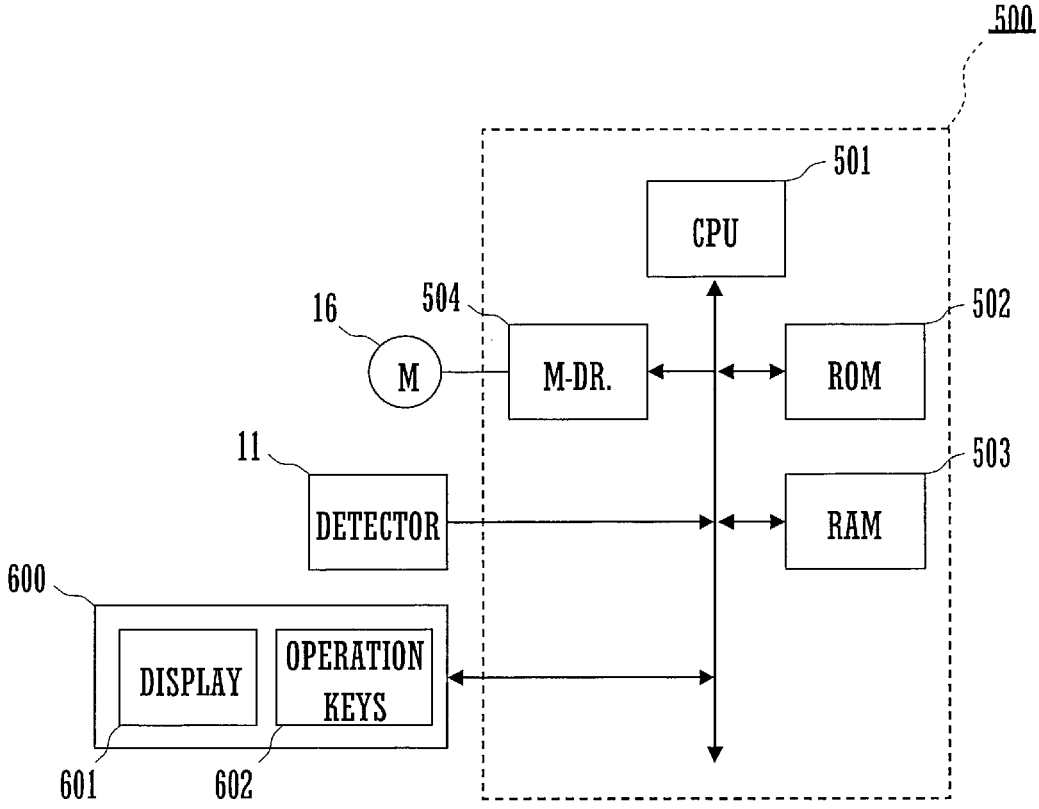
FIG. 4 is a block diagram of a controller of the belt transfer device.

FIG. 4 shows the structure of the controller 500 of the belt transfer device 10. The controller 500 includes a CPU 501, a ROM 502, a RAM 503, and a motor driver 504. The CPU 501 is connected to the ROM 502, the RAM 503, the driver 504, the detector 11, and an operation panel 600. The ROM 502 stores the program specifying the operation of the CPU 501. The RAM 503 temporarily stores the data input to and output from the CPU 501. The driver 504 is connected to a motor 16, which turns the rotary cam 5. The operation panel 600 is positioned on the top of the apparatus 100 and fitted with a display 601 and operation keys 602.

As is the case with general image forming apparatus, the detector 11 is fitted to the belt transfer device 10 in order to sense whether the shifter 7 is positioned properly during processes of image formation and the standby periods between them.

The controller 500 is independent for the belt transfer device 10 but could be common to it and the apparatus 100.

Figure 5:
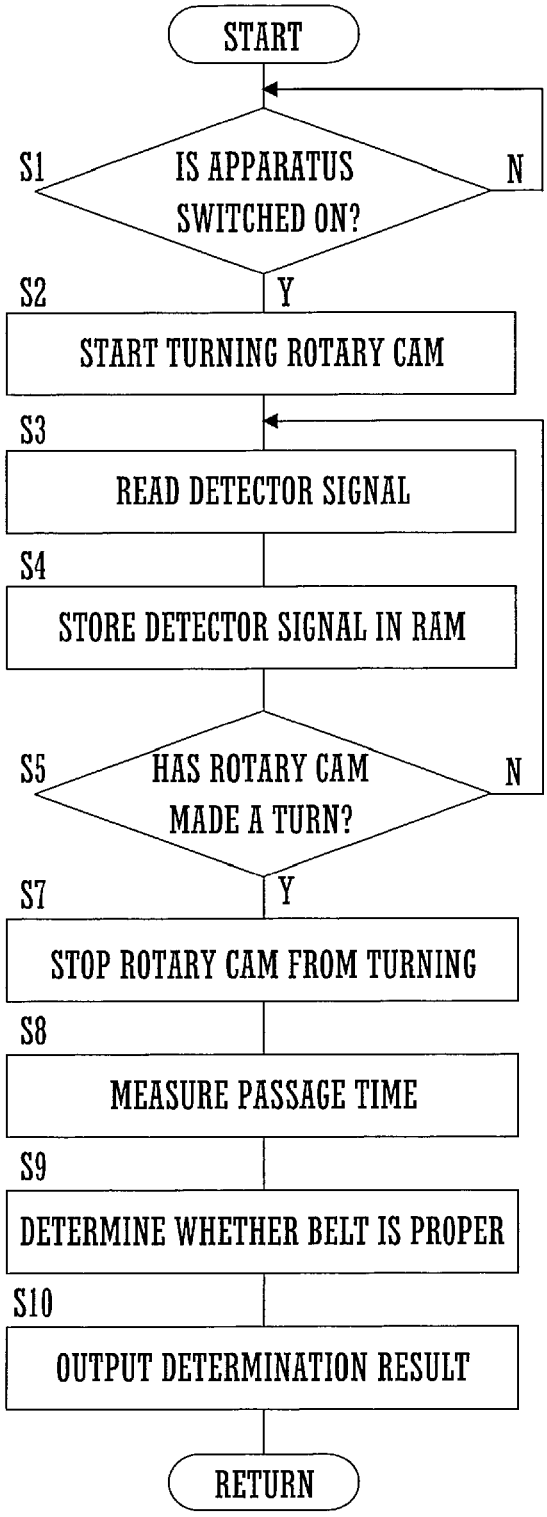
FIG. 5 is a flowchart of an operation of the controller.

FIG. 5 shows the operation of the controller 500. When the apparatus 100 is switched on (S1), the CPU 501 outputs driving data on the motor 16 to the motor driver 504 and makes the driver start the motor rotating (S2). The CPU 501 reads the signal from the detector 11 (S3) and stores it in the RAM 503 (S4). While the cam 5 is making a turn, the CPU 501 repeats steps S3 and S4 (S5). When the cam 5 completes the turn, the CPU 501 makes the driver 504 stop the motor 16 (S6). Based on the signal stored in the RAM 503, the CPU 501 measures the time during which part of the shifter detection piece 75 has moved through the detector 11 (S7). The CPU 501 compares the measured time with a preset reference time so as to determine whether the length of the intermediate transfer belt 2 is suitable (S8). Then, the CPU 501 outputs to the display 601 data indicating the result of the determination (S9).

Figure 6A:
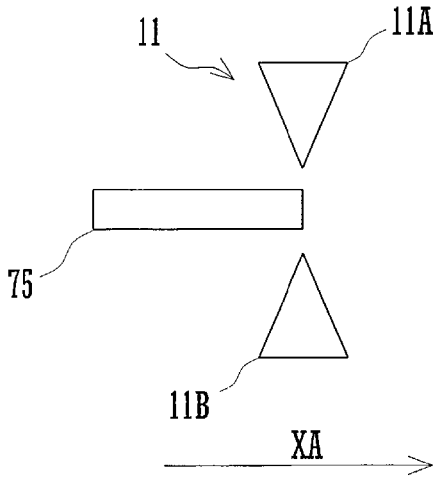
FIGS. 6A and 6B show how a detector of the belt transfer device senses an object.
Figure 6B:
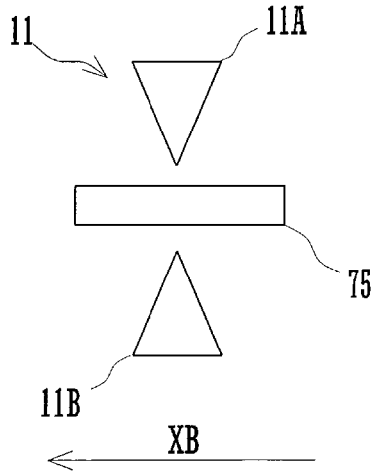
Figure 6C:
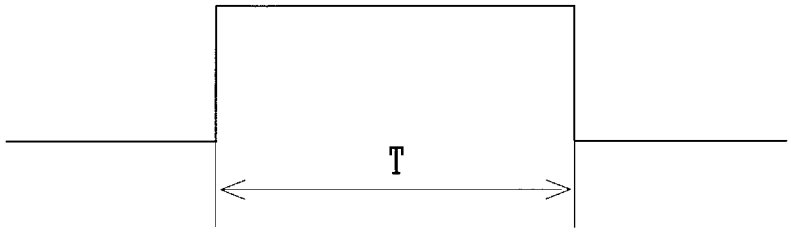
FIG. 6C shows a signal output from the detector.

FIGS. 6A and 6B show how the detector 11 of the belt transfer device 10 senses the detection piece 75 of the shifter 7. FIG. 6C shows a signal output from the detector 11. While the rotary cam 5 is making each turn, the shifter 7 reciprocates once in the directions X. The shifter reciprocation is influenced by the elastic force of the compression springs 84 and 94 and the tensile force of the intermediate transfer belt 2.

The cam follower 71 of the shifter 7 is kept in compressive contact with the inner cam 52 by the compression spring 84.

During the standby periods between processes of image formation, the shifter 7 is positioned as shown in FIG. 2. During the processes of image formation, the shifter 7 is positioned as shown in FIG. 3. During the moving periods when the shifter 7 is moving to the right in the directions X from its position in FIG. 2 to its position in FIG. 3, the compressive contact of the shifter pins 72 and 73 with the arms 81 and 91 respectively keeps the elastic force of the compression springs 84 and 94 acting as resistance force. During an initial part of each of the moving periods, the tensile force of the intermediate transfer belt 2 acts as bias force through the tension roller 83. During the remaining part of each of the moving periods, the belt force acts as resistance force through the transfer roller 8 and nip adjusting roller 9.

During the moving periods when the shifter 7 is moving to the left in the directions X from its position in FIG. 3 to its position in FIG. 2, the compressive contact of the shifter pins 72 and 73 with the arms 81 and 91 respectively keeps the elastic force of the compression springs 84 and 94 acting as bias force. During an initial part of each of these moving periods, the tensile force of the intermediate transfer belt 2 acts as bias force through the transfer roller 8 and nip adjusting roller 9. During the remaining part of each of these moving periods, the belt force acts as resistance force through the tension roller 83.

While each turn of the rotary cam 5 is reciprocating the shifter 7 once, the light receiving element 11B of the detector 11 does not receive the light from the light emitting element 11A of the detector and outputs no light reception signal during the time T when the shifter detection piece 75 is moving in the direction XA from its position in FIG. 6A to its position in FIG. 6B and then returning in the direction XB to the position in FIG. 6A. The light reception signal output from the receiving element 11B is inverted as shown in FIG. 6C. The inverted signal is input as a detector signal into the CPU 501.

The time T, during which the detector 11 outputs a signal while the rotary cam 5 is making a turn, varies with the reciprocating time taken by the shifter 7 to reciprocate once in the directions X. The reciprocating time depends on the elastic force of the compression spring 84 or 94 or the tensile force of the intermediate transfer belt 2.

For example, on the condition that the driving roller 3 is in its proper position for the length of the intermediate transfer belt 2, the tensile force of this belt increases with the belt length. The ROM 502 stores in advance a reference value of the time T, during which the detector 11 outputs a signal while the rotary cam 5 is making a turn. By measuring the time T and comparing it with the reference value, it is possible to determine whether the length of the intermediate transfer belt 2 is proper.

The CPU 501 displays on the display 601 of the apparatus 100 the result of the determination whether the length of the intermediate transfer belt 2 is proper. The displayed result makes it possible to know whether the length of the belt 2 fitted to the belt transfer device 10 is proper. This makes it possible to fit the transfer device 10 with the belt 2 of the length optimum for the apparatus 100.

The process shown in FIG. 5 is carried out when the belt transfer device 10 and the apparatus 100 are produced. This makes it possible to produce an image forming apparatus 100 including a belt transfer device 10 fitted with an intermediate transfer belt 2 of the optimum length.

If two intermediate transfer belts 2 of different lengths are provided for two or more destinations of the apparatus 100, the reference value for each of the destinations is stored in advance in the ROM 502. In an example where the compression springs 84 and 94 were common to the two belts 2, the time T, during which the detector 11 output a signal while the rotary cam 5 was making a turn, was 619 ms with the longer belt 2 and 639 ms with the shorter belt 2.

The compression spring 84 prevents the arm 81 from pivoting clockwise in FIG. 2 due to the tensile force of the intermediate transfer belt 2 and the weight of this arm etc., weakening the force biasing the shifter 7 to the left in FIG. 2. This keeps the cam follower 71 in compressive contact with the inner cam 52. The elastic force that the spring 84 is required to have may depend on the length of the belt 2. In an example where the compression spring 94 and the belt 2 were common to two compression springs 84 different in elastic force, the time T, during which the detector 11 output a signal while the rotary cam 5 was making a turn, was 639 ms with the spring 84 that was 2 kgf in elastic force and 636 ms with the spring 84 that was 2.5 kgf in elastic force. By comparing the measured time T with the reference value, it is also possible to determine whether the spring 84 is suitable.

The belt transfer device 10 includes three color units and three more rotary cams. Each of the color units includes a shifter and an arm, which supports one of the transfer rollers 312-314 for compressive contact with the photoconductor drums 311B-311D respectively. Each of these rotary cams turns to reciprocate the shifter of one of the color units in the directions X, turning the associated arm. The tension roller 83 might be supported by the arm supporting one of the transfer rollers 312-314. In this case, the detector 11 might sense the position of the shifter of the associated color unit. The shifters of the color units position the transfer rollers 312-314 in transfer positions during processes of color image formation, and in home positions during processes of monochromatic image formation and the standby periods between the processes.

The belt transfer device 10 has been described above as applied to the apparatus 100 for color image formation but might be applied to an apparatus for monochromatic image formation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A belt transfer device comprising:

a main frame;

a plurality of rollers supported by the main frame;

an intermediate transfer belt made of elastic material;

the intermediate transfer belt running over the rollers;

a transfer member for primarily transferring a toner image on an image carrier to the intermediate transfer belt;

a shifter reciprocatable in specified directions so as to shift the transfer member between a transfer position where the transfer member is in compressive contact with an inner surface of the intermediate transfer belt and a home position where the transfer member is away from the belt surface;

a detector for outputting a signal representing the position of the shifter in the specified directions; and a controller for determining whether the tensile force of the intermediate transfer belt is proper based on the state of the signal output from the detector while the shifter is reciprocating each time in the specified directions so as to determine whether a length of the intermediate transfer belt running over the rollers is proper;

the belt transfer device being adapted to secondarily transfer the toner image on the intermediate transfer belt to a sheet of paper.

2. A belt transfer device as claimed in claim 1, wherein the detector senses the shifter in a specified position in the specified directions, and wherein the controller determines whether the tensile force of the intermediate transfer belt is proper, based on the time during which the signal is output.

3. A belt transfer device as claimed in claim 2, wherein the shifter includes a detection piece formed thereon, and wherein the signal indicates the time during which the detection piece is present in the specified position while the shifter is reciprocating each time in the specified directions.

4. A belt transfer device as claimed in claim 1, further comprising an elastic member biasing the transfer member toward the home position.

5. A belt transfer device as claimed in claim 1, further comprising:

a rotary cam supported rotatably on a rotation axis by the main frame and a supporting mechanism including an arm supported pivotably on a pivot axis by the main frame;

the transfer member being so supported by the arm as to shift relative to the main frame;

the shifter engaging with the arm;

the shifter being supported by the supporting mechanism reciprocatably in the specified directions;

the shifter being adapted to reciprocate on a plane perpendicular to the rotation and pivot axes while the rotary cam is turning.

6. A belt transfer device as claimed in claim 5, further comprising a tension roller for selectively contacting the inner surface of the intermediate transfer belt so as to keep the belt under constant tension, the tension roller being so supported by the arm as to be away from the intermediate transfer belt while the transfer member is in the transfer position, and as to be in compressive contact with the belt while the transfer member is in the home position.

7. A belt transfer device for transferring a monochromatic toner image on a monochromatic image carrier and color toner images on a plurality of color image carriers to a sheet of paper, the monochromatic and color image carriers being arranged on a line, the transfer device comprising:

a main frame;

a plurality of rollers supported by the main frame;

an intermediate transfer belt made of elastic material;

the intermediate transfer belt running over the rollers;

a monochromatic image transfer member for primarily transferring the monochromatic toner image on the monochromatic image carrier to the intermediate transfer belt;

color image transfer members each for primarily transferring the color toner image on one of the color image carriers to the intermediate transfer belt;

shifters reciprocatable in specified opposite directions so as to each shift one of the monochromatic and color image transfer members between a transfer position where the transfer member is in compressive contact with an inner surface of the intermediate transfer belt and a home position where the transfer member is away from the belt surface;

a detector for outputting a signal representing the position of one of the shifters in the opposite directions; and a controller for determining whether the tensile force of the intermediate transfer belt is proper based on the state of the signal output from the detector while the associated shifter is reciprocating each time in the opposite directions so as to determine whether a length of the intermediate transfer belt running over the rollers is proper;

the belt transfer device being adapted to secondarily transfer the monochromatic and color toner images on the intermediate transfer belt to the sheet of paper.

* * * * *